United States Patent [19]

Santo

[11] Patent Number: 4,941,223

[45] Date of Patent: Jul. 17, 1990

[54] WATERBED MATTRESS MARGINAL PERIMETER AIR SUPPORT AND METHOD OF MANUFACTURE THEREOF

[76] Inventor: Philip J. Santo, 12 Mountain Rd., Rochester, N.Y. 14625

[21] Appl. No.: 158,640

[22] Filed: Feb. 19, 1988

[51] Int. Cl.[5] ..... A47C 27/08

[52] U.S. Cl. ..... 5/452; 5/451; 156/217

[58] Field of Search ..... 5/451, 452, 450, 444; 156/217

[56] References Cited

U.S. PATENT DOCUMENTS 4,513,463 4/1985 Santo ..... 5/452
4,700,419 10/1987 Santo ..... 5/452

*Primary Examiner*—Alexander Grosz
*Attorney, Agent, or Firm*—Lawrence P. Kessler

[57] ABSTRACT

An improved construction for an air perimeter support for the marginal perimeter of a waterbed mattress, and the method for manufacturing such improved air perimeter support. The improved air perimeter support includes a first sheet of flexible, substantially dimensionally stable material folded back on itself and joined together at a location spaced from the longitudinal marginal side edges thereof to form an elongated chamber, of substantially rectangular cross-section, intermediate the marginal side edges. One longitudinal marginal side edge is again folded back and joined to the chamber at the wall opposite the wall formed by the other longitudinal marginal side edge. A second sheet of flexible, substantially dimensionally stable material, is located in the interior of the elongated chamber and joined to at least three adjacent walls of the chamber starting with the the wall to which the one longitudinal marginal side edge is joined and going around said chamber opposite to the fold of the one longitudinal marginal side edge.

9 Claims, 3 Drawing Sheets

WATERBED MATTRESS MARGINAL PERIMETER AIR SUPPORT AND METHOD OF MANUFACTURE THEREOF

BACKGROUND OF THE INVENTION

This invention relates in general to an air perimeter support for waterbed mattresses, and more particularly to a marginal perimeter support of simplified construction and the metod of manufacture for such air perimeter support.

In my recent U.S. Pat. No. 4,513,463 (issued Apr. 30, 1985), I have disclosed a new and improved air perimeter support for the marginal perimeter of a waterbed mattress in a floatation sleep system. Such air perimeter support employs a cantilevered member extending from the top portion of the air perimeter support to a location beneath the waterbed mattress. As a result of the particular location of such member, the weight of the mattress is utilized to create a force on the air perimeter support to retain such support in effective marginal perimeter support relation with the mattress. This force also serves to maintain the shape of the air perimeter support (i.e., prevents bowing out of the air perimeter support). Additionally, the air perimeter support includes a plurality of internal struts which are particularly located to maintain the cross-sectional shape of the air perimeter support so that its overall external configuration is substantially rectilinear. This gives the air perimeter support a highly desireable appearance similar to that of conventional bedding, such as a box spring and stuffed mattress.

Construction of this patented air perimeter support involves joining (such as by heat sealing) of individual elements of the air perimeter support together in a step-by-step process to build up a complete unit. While such construction provides a suitable air perimeter support product, it is heavily dependent on intensive manual labor, which materially adds to the cost of such product.

SUMMARY OF THE INVENTION

This invention is directed to an improved construction for an air perimeter support for the marginal perimeter of a waterbed mattress, and the method for manufacturing such improved air perimeter support. The improved air perimeter support includes a first sheet of flexible, substantially dimensionally stable material folded back on itself and joined together at a location spaced from the longitudinal marginal side edges thereof to form an elongated chamber, of substantially rectangular cross-section, intermediate the marginal side edges. One longitudinal marginal side edge is again folded back and joined to the chamber at the wall opposite the wall formed by the other longitudinal marginal side edge. A second sheet of flexible, substantially dimensionally stable material, is located in the interior of the elongated chamber and joined to at least three adjacent walls of the chamber starting with the wall to which the one longitudinal marginal side edge is joined and going around said chamber opposite to the fold of the one longitudinal marginal side edge.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
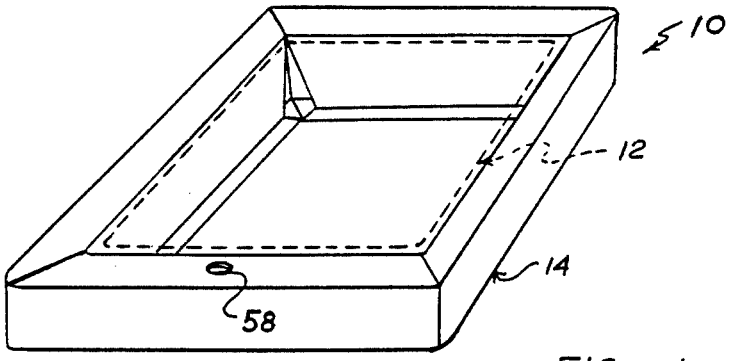
FIG. 1 is a view, in perspective, of a floatation sleep system including the improved air perimeter support for the waterbed mattress thereof according to this invention.

Referring now to the accompanying drawings, FIG. 1 show a floatation sleep system, designated generally by the numeral 10, including a waterbed mattress 12 and an improved air perimeter support 14, according to this invention, for the marginal perimeter of such mattress. The air perimeter support 14 is an improved construction of the air perimeter support of my aforementioned U.S. Pat. No. 4,513,463, and functions to support the marginal perimeter of the mattress 12 and maintain its shape in the same manner as fully described in such patent. The function of the air perimeter support is described herein only to the extent necessary for a complete understanding of this invention.

Figure 2:
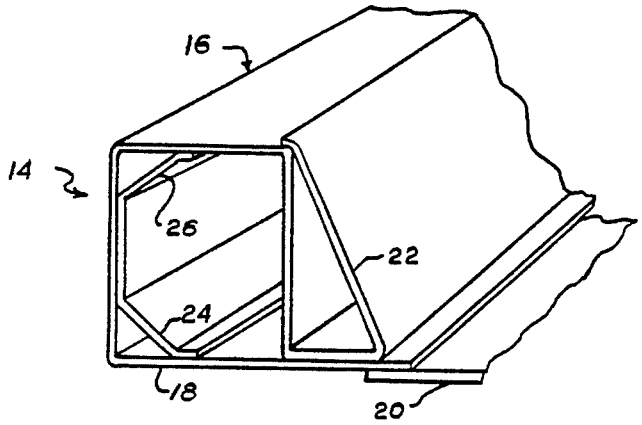
FIG. 2 is a cross-sectional view , in perspective and on an enlarged scale, of a portion of the improved air perimeter support of FIG. 1.

The air perimeter support 14, as best shown in FIG. 2 comprises an air chamber 16, defined by a sheet 18 of flexible, substantially dimensionally stable material. The air chamber 16, which is adapted to surround the marginal perimeter of the waterbed mattress 12, has a sheet 20 connected to the bottom of the air chamber extending beneath the mattress. A cantilever member 22 extends from the top of the air chamber 16 and is connected to the sheet 20 at a location such that the weight of the waterbed mattress contained in the cavity of the air perimeter support 14 over the sheet 20 acts on the cantilever member to create a force which retains the air perimeter support in effective marginal perimeter support relation with the mattress and maintains the shape of the air perimeter support. A plurality of internal struts 24, 26 are connected to the interior walls of the air chamber 16 at particular locations to maintain the cross-sectional shape so that the overall external configuration of the air frame 14 is substantially rectilinear.

According to this invention, the improved construction for the air perimeter support 14 involves a substantial reduction in the number of its component parts which, in turn, enables the air perimeter support to be manufactured in an improved manner which substantially reduces the intensive manual labor previously required for its production. As can be readily seen in FIG. 2, the sheet 18 defining the air chamber 16 and the cantilever member 22 are in fact formed from one sheet of material. Similarly, the internal struts 24, 26 are formed of one sheet of material.

Figure 3:
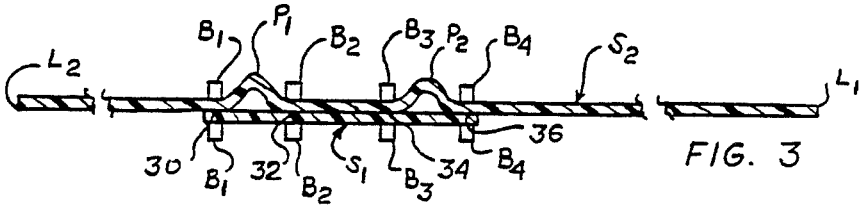
FIGS. 3 through 5 are side elevational views, in cross-section, respectively depicting the steps, according to this invention, for manufacturing the improved air perimeter support shown in FIG. 1.

With only two sheets of material comprising the basic air perimeter chamber 14, such chamber can be simply constructed in the following manner. A first elongated sheet $S_1$ (see FIG. 3) is laid out on a flat surface. A second elongated sheet $S_2$ of substantially greater width is laid out on the flat surface over the sheet $S_1$. Two portions $P_1$, $P_2$ of the sheet $S_2$ are drawn substantially together by hand, or by any suitable mechanical clamping mechanism. A plurality of elongated pairs of joining members, such as resistance bars $B_1$–$B_4$ of typical heat sealing equipment, are placed in juxtaposition with the sandwiched sheets $S_1$ and $S_2$. Bars $B_1$ and $B_4$ are located adjacent to the longitudinal marginal side edges $L_1$, $L_2$ of the sheet $S_1$, and the bars $B_2$ and $B_3$ are respectively located on the inside margin of the projections $P_1$ and $P_2$. The bars are then actuated to heat seal the sheets $S_1$ and $S_2$ together along the appropriately located lines 30–36. Of course, other methods of joining the sheets along the appropriately located lines, such as glueing for example, are suitable for use with this invention, as long as they provide a reliable airtight seal therebetween.

Figure 4:
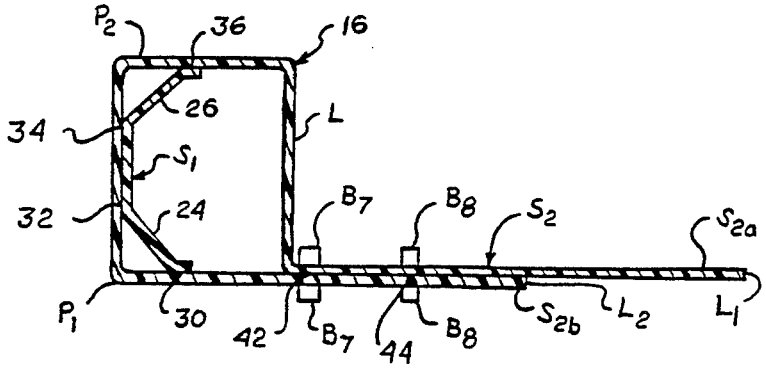
Figure 7:
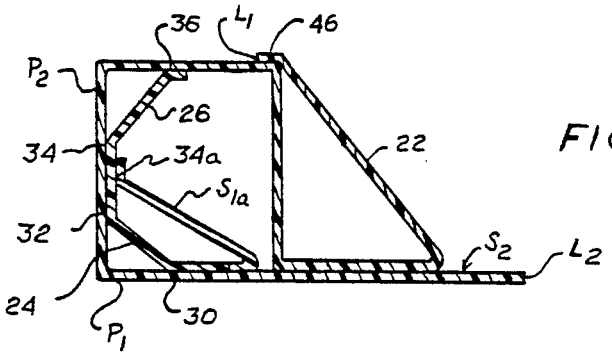
FIG. 7 is an end view, in cross-section, of an alternate embodiment of the air perimeter support according to this invention.

Thereafter, sheet $S_2$ is folded back on itself so that a loop L is formed with sheet $S_1$ located internally thereof, and marginal edge $S_2$ extends over marginal edge $S_{2b}$ (see FIG. 4). As a result of the sealing of sheets $S_1$ and $S_2$ along the lines 30–36, the loop L will take a substantially rectilnear cross-sectional configuration with the projections $P_1$ and $P_2$ assuming a substantially right angle shape; and the segments of sheet $S_1$ respectively between lines 30 and 32 and between lines 34 and 36 form the internal struts 24 and 26 which serve to maintain the rectilinearity of the air chamber 16 (loop L). Pairs of heat sealing bars $B_7$ and $B_8$ are then placed in juxtaposition with the overlapped portion of the sheet $S_2$, with the bars $B_7$ located at the base of the loop L where the portions of the sheet $S_2$ come back together and bars $B_8$ located on the side of the bars $B_7$ opposite the loop L. The bars $B_7$ and $B_8$ are actuated to heat seal the overlapped portions of the sheet $S_2$ together along the appropriately located lines 42, 44. If it is desired to further insure rectilinearity of the air chamber, prior to sealing the overlapped portions of sheet $S_2$, an elongated portion $S_1$ of sheet $S_1$ is looped back and sealed to itself along the line 34*a* between lines 32 and 34 (see FIG. 7).

Figure 5:
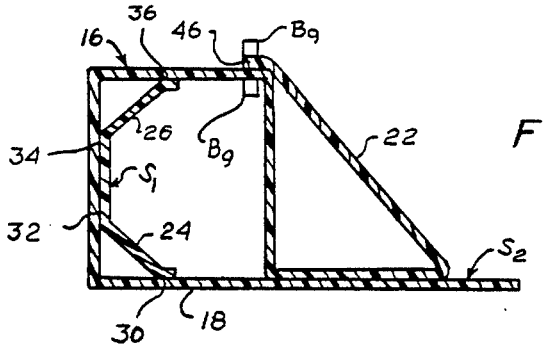

Subsequently, marginal edge $S_2$ is again folded back on itself to locate such edge adjacent to the top of loop L (see FIG. 5). A pair of heat sealing bars B is then placed in juxtaposition with the location of the marginal edge $S_2$ over the loop L, and the bars are actuated to heat seal such marginal edge to the loop along the appropriately located line 46. In this manner, the portion of the sheet $S_2$ extending from the marginal edge $S_2$ toward the marginal edge $S_{2b}$ forms the cantilever member 22.

Figure 6:
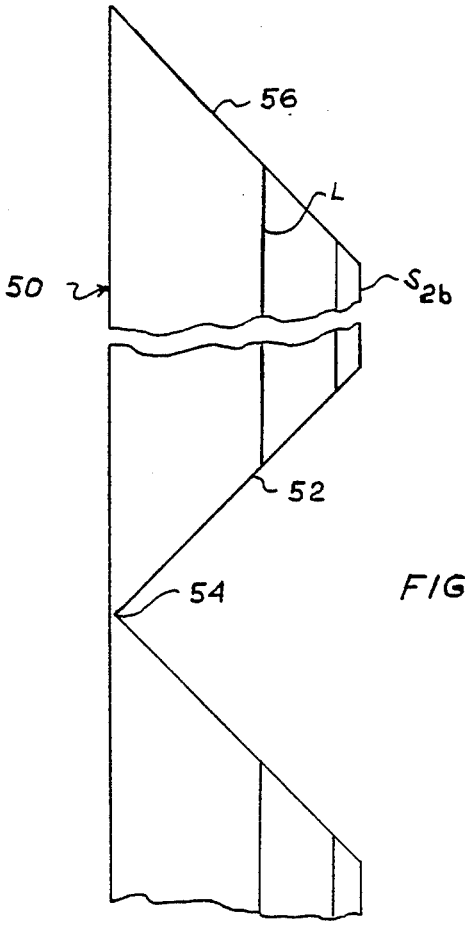
FIG. 6 is a top plan view of an elongated arrangement from which the improved air perimeter support is finally constructed.

In order to complete the construction of the air perimeter support 14, the elongated arrangement 50 (see FIG. 6) formed in the above manner is cut to a length of the desired external perimeter of the support. Such external perimeter length can be standardized for the various standard sizes of floatation sleep system mattresses. A series of V-shaped cutouts 52 are made in the elongated arrangement 50 extending from the marginal edge $S_{2b}$ through the loop L but not through the vertical wall to which the sheet $S_1$ is sealed. The apexes 54 of the cutouts 52 are spaced apart respective distances corresponding to the desired longitudinal dimensions of the sides of the air perimeter support. The ends 56 of the elongated arrangement 50 are respectively notched so that when the arrangement is folded at the apexes 54, the ends 56 mate to form the desired rectangular configuration for the air perimeter support 14. The ends 56 and cutouts 52 can then be sealed in any well known manner to complete the air chamber 16. Finally, a valve 58 is sealed in the a wall of the air chamber 16 to enable the chamber to be selectively pressurized, and the bottom sheet 20 is attached, along its marginal edges, to the marginal edge $S_{2a}$ to complete the construction of the air perimeter support 14.

In the alternative, the elongated arrangement 50 can be cut to form standard length sections corresponding to desired longitudinal dimensions of the respective sides of standard sized air perimeter supports. The ends of such sections are respectively notched as described above. Accordingly, selected sections can then be sealed together in any well known manner to complete an air perimeter support of desired perimeter dimension.

Figure 8:
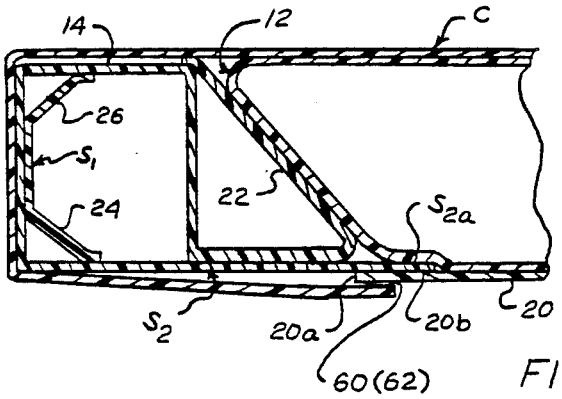
FIG. 8 is an end view, in cross-section, of a portion of the air perimeter support according to this invention, with a bottom sheet and cover attached thereto.

It should be noted that the bottom sheet 20 may be formed with a portion 20*a* extending beyond the lines 20*b*, along which the sheet is sealed to the marginal edges $S_{2a}$, and within the vertical projection of the interior wall of the loop L (see FIG. 8). The portion 20*a* includes a fastening member 60 on the under side thereof, which is mateable with a complementary fastening member 62. The fastening member 62 is attached to a marginal edge of a decorative cover adapted to be placed over the assembled air perimeter support 14 and the waterbed mattress 12 contained therewithin. The fastening members 60, 62 may be of the hook and loop type for example. The weight of the water in the mattress assures that the fastening members are substantially locked in place.

The invention has been described in detail with particular reference to a preferred embodiment thereof, but it will be understood that variations and modifications can be effected within the spirit and scope of the invention.

I claim:

1. An air perimeter support for supporting the marginal perimeter of a waterbed mattress, said air perimeter support comprising:

a first elongated sheet of flexible, substantially dimensionally stable material folded back on itself and joined together at a location spaced from the longitudinal marginal side edges thereof to form an elongated chamber, of substantially rectangular cross-section, intermediate said longitudinal marginal side edges, one longitudinal marginal side edge being again folded back and joined to said chamber at the wall opposite the wall formed by the material adjacent to the other longitudinal marginal side edge; and a second sheet of flexible, substantially dimensionally stable material, said second sheet being located in the interior of said elongated chamber and joined to at least three adjacent walls of said chamber starting with the said wall to which said one longitudinal marginal side edge is joined, and going around said chamber opposite to the fold of said one longitudinal marginal side edge.

2. The invention of claim 1 wherein assemblies of said first and second sheets are of appropriate lengths corresponding to lengths of sides of a desired external perimeter of said air perimeter support, and selected lengths are sealed together to form said air perimeter support.

3. The invention of claim 2 further including a bottom sheet attached to said formed assemblies, said bottom sheet having a portion extending beyond the line of attachment between said sheet and said assemblies, said portion including means for releasably attaching a cover for said air perimeter and waterbed mattress.

4. The invention of claim 1 wherein the assembly of said first and second sheets is of a length corresponding to the length of a desired external perimeter of said air perimeter support, said assembly defining a plurality of cutouts spaced apart a distance corresponding to the lengths of the sides of said support so that edges of said cutouts can be sealed together to form said air perimeter support.

5. A method for manufacturing an air perimeter support for supporting the marginal perimeter of a waterbed mattress, said method comprising the steps of:

(1) on a substantially flat surface, overlaying an elongated flexible, substantially dimensionally stable sheet of a first width with an elongated flexible, substantially dimensionally stable sheet of a second width greater than the width of said first sheet;

(2) gathering two spaced apart portions of said second sheet intermediate and substantially parallel to the longitudinal marginal side edges thereof so that said portions are spaced from said first sheet;

(3) sealing said second sheet to said first sheet along substantially parallel lines respectively on either side of said gathered portions of said second sheet;

(4) folding said second sheet back on itself with one longitudinal marginal side edge overlying the other longitudinal marginal side edge to form a loop with first sheet being internal of said loop;

(5) sealing together portions of said second sheet along a line at the base of said loop;

(6) sealing together portions of said second sheet along a line parallel to said line at the base of said loop and between said line at the base of said loop and said longitudinal marginal side edge;

(7) folding one longitudinal marginal side edge back to the top of said loop; and (8) sealing said one longitudinal marginal side edge to the top of said loop to form an elongated arrangement.

6. The invention of claim 5 wherein the sealing steps (5) and (6) are accomplished at substantially the same time.

7. The invention of claim 5, further including the steps of cutting said formed elongated arrangement to a plurality of lengths corresponding respectively to lengths of portions of the external perimeter of the air perimeter support, and joining such cut ends together.

8. The invention of claim 7 further including the step of attaching a bottom sheet to said joined assembly of elongated arrangement lengths.

9. The invention of claim 5 further including the steps of cutting said formed elongated arrangement to a length corresponding to the length of the desired external perimeter of the air perimeter support; oppositely notching the ends of said elongated arrangement; providing a series of V-shaped cutouts in said elongated assembly intermediate said notched ends at intervals between said notched ends spaced apart so that the distance between the apexes of respective cutouts correspond to the desired longitudinal dimensions of the sides of said air perimeter support; and joining such notched ends together.

* * * * *